US010325529B1

(12) United States Patent
Kuhn

(10) Patent No.: US 10,325,529 B1
(45) Date of Patent: Jun. 18, 2019

(54) INTERACTIVE WARNING SYSTEMS AND METHODS

(71) Applicant: Todd Kuhn, Mims, FL (US)

(72) Inventor: Todd Kuhn, Mims, FL (US)

( * ) Notice: Subject to any disclaimer, the term of this patent is extended or adjusted under 35 U.S.C. 154(b) by 0 days.

(21) Appl. No.: 15/895,656

(22) Filed: Feb. 13, 2018

(51) Int. Cl.
*G09F 3/10* (2006.01)
*G09F 3/00* (2006.01)
*G09F 3/02* (2006.01)

(52) U.S. Cl.
CPC ..... *G09F 3/10* (2013.01); *G09F 3/0297* (2013.01); *G09F 2003/0208* (2013.01); *G09F 2003/0266* (2013.01)

(58) Field of Classification Search
CPC ..... G09F 3/14
See application file for complete search history.

(56) References Cited

U.S. PATENT DOCUMENTS 8,281,929 B2 * 10/2012 Franks ..... B65D 23/14 206/534
2007/0214695 A1 * 9/2007 Frank ..... G09F 3/14 40/664
2009/0223099 A1 * 9/2009 Versteeg ..... G06Q 99/00 40/6
2011/0258896 A1 * 10/2011 Watson ..... B29C 45/14836 40/664
2013/0103488 A1 * 4/2013 Orloff ..... G09F 23/0083 705/14.39
2014/0366416 A1 * 12/2014 Stephanopoulos ..... G09F 15/0025 40/662

(Continued)

OTHER PUBLICATIONS

Gizmodo, New Warning Label: Lithium Ion Batteries May Explode, https://gizmodo.com/5152101/new-warning-label-lithium-ion-batteries-may-explode, Feb. 12, 2009 (Year: 2009).*

(Continued)

*Primary Examiner* — Gary C Hoge
(74) *Attorney, Agent, or Firm* — Brian S. Steinberger; Law Offices of Brian S. Steinberger, P.A.

(57) ABSTRACT

An interactive, multi-message, multimedia hazard communication labeling and hazard control system which communicates critical consumer safety information, including: 1) the core or principal hazard (i.e., "FALL HAZARD"); 2) a core or principle signal word (i.e., "DANGER," "CAUTION," "WARNING," etc.) which indicates the level of hazard; 3) the core or principal consequence(s) of interaction with that hazard (i.e., "Failure to follow these instructions may result in serious injury or death!"); 4) the core or principal hazard controls and/or hazard mitigation messages arranged in around the periphery or in close proximity of the principal hazard depicted graphically; 5) the core or principal hazard controls and/or hazard mitigation messages arranged around the periphery or in close proximity of the principal hazard in text format; 6) a quick response (QR) code which provides a scannable, digital link to a web-based platform which provides both specific, as well as, general hazard control information about the control of the core or principal hazard; and 7) a Uniform Resource Locator (URL) which links directly to the web-based information providing digital web-based information about the control of the core or principle hazard.

18 Claims, 14 Drawing Sheets

QR Logos for Front of Box Packaging.

(56) References Cited

U.S. PATENT DOCUMENTS

2016/0328775 A1* 11/2016 Lloyd ..... G06Q 30/0625

OTHER PUBLICATIONS

Daily Ramblings, GensAce/Tattu R-LIne 1300mAh 4s 95C Testing, https://matthew-evans.info/2016/08/22/gensace-tattu-r-line-1300mah-45-95c-testing/, Aug. 22, 2016 (Year: 2016).*
Warning Labels, http://allinthefamilyadoption.com/warning-labels/, Nov. 5, 2012 (Year: 2012).*

* cited by examiner

QR Logos for Front of Box Packaging.

WARNING #1 IWS QR Logo on the outside of the product packaging.

FIG. 2A

20

ATTENTION!

You must view an important safety video BEFORE using your treestand product. The video can be viewed online using your smart phone, tablet, laptop, desktop computer, smart TV and any other compatible device by visiting www.standsafety.com or you can scan the QR code with your smart phone or other compatible device.

WATCH ONLINE

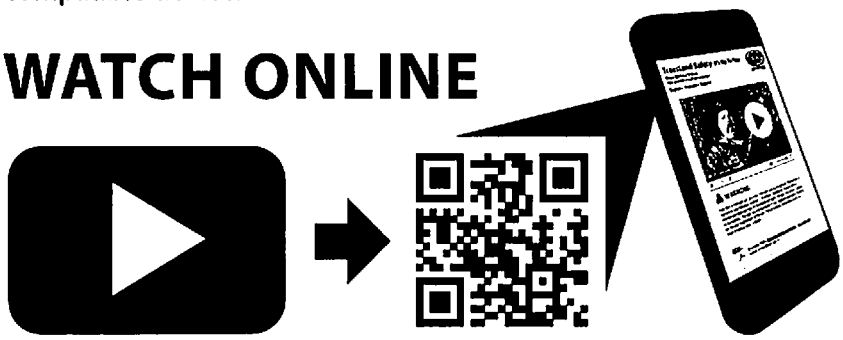

standsafety.com Scan this QR code

WARNING

You must view the online safety video and read the manufacturer's product(s) assembly, set-up and use instructions in their entirety prior to attempting to use this product(s). Do not attempt to use or operate this product(s) in any manner if you have any questions regarding its assembly, set-up or use. Contact the manufacturer immediately with questions regarding the safe operation of this product(s). Failure to follow these instructions may result in serious injury or death!

If you do not have a smart phone, tablet, laptop, desktop computer, smart TV or any other compatible device, ask a friend or relative to borrow one or visit your local library to view the safety video. If you cannot view the online safety video by any means listed above, send a written request to receive a DVD version of the video at the address below. Make sure you include the treestand brand, model number, purchase date, your full name, mailing address, City, State and zip code.

IWS DVD Request
PO Box 25235
Salt Lake City, UT 84125-0235

Part #: HA-INSERT-FP for Fixed Position (Hang-On) stands.

© 2017 Interactive Warning Systems Inc.

QR Logos for Manufacturer's Instructions

Front

Back

INTERACTIVE WARNING SYSTEMS AND METHODS

FIELD OF INVENTION

This invention relates to warnings for hazardous products, and in particular to interactive warning systems, and methods for providing multiple warning labels, instructions, and videos for providing repetitive instructions and warnings to consumers using hazardous products, such as tree stands, and ladders, and the like.

BACKGROUND AND PRIOR ART

All consumer products have inherent hazards. These hazards expose consumers to the potential of bodily harm. The degree of bodily harm varies with each consumer product. It is generally accepted that industry began warning employees of hazardous conditions in the early 1900's. Early WARNING signs were as simple as an "arrow" which was used to point to the actual hazard (FIG. 1). These early signs were crude at best.

In 1941, the first U.S. safety sign standard (ASA Z35.1) required manufacturers to use the signal words "DANGER" and "CAUTION" on signs with a short text message identifying the hazard (i.e., "HOT," "HIGH VOLTAGE," etc.)

In 1971, the Occupational Safety and Health Administration (OSHA) adopted the ASA Z35.1 Standard in their general industry guidelines in their new work safety standards. In 2002, the American National Standards Institute (ANSI) added the option to include symbols and content on the consequence of interaction with the hazard and how to avoid the hazard.

In 2004, the International Organization for Standardization (ISO) promulgated standards for "symbol-only" hazard warnings. In 2013, OSHA integrated the 2002 ANSI standards into its regulations.

Some products have very low levels of potential risk of harm. Other products possess significant levels of potential harm and risk. A chainsaw for instance, with its high-speed rotating, exposed chain, carries considerably more risk-of-operation than does a traditional hand saw.

The ability of a manufacturer to convey safety information on product-related hazards is crucial and critical to keeping consumers safe. Product related injuries and deaths related to consumer products lead to civil litigation which clogs the court system and subsequent legal tort awards drive insurance premiums for consumer products up resulting in higher consumer product prices.

Product related injuries suffered by consumers are always preventable. Misinformed or uninformed consumers, or those who receive inadequate product hazard warnings and product-use instructions are those most often injured. Current product warning labels, signs, tags, and the such are tedious to read and confusing at best. These consumer product warning labels have confusing themes and lack clear and concise hazard communication.

Manufacturers are faced with the inability of relate how to eliminate product related hazards without repeating the principle hazard, the consequence of interaction with the principle hazard and the signal word over-and-over for each hazard. This results in repetitive and long safety messaging. That messaging which the consumer quickly quits reading and abandons.

Products with multiple hazards and multiple hazard control strategies often present very cluttered and confusing warnings as redundant information is provided on the warning labels. A system which presents this information in a clear and concise manner is required and needed.

Modern product safety placards, labels, tags, etc. provide a single method for controlling or mitigating a hazard. For instance, if a product, such as a ladder possesses the potential of a user falling, hence a "FALL HAZARD" the hazard mitigation strategy is "Safety equipment required when climbing ladder." While this single, lone fall hazard mitigation strategy provides some assistance, it does not address the many other strategies which could prove successful in preventing the "FALL HAZARD." These may include: 1) reading the instructions for ladder usage prior to use; 2) inspecting the ladder prior to use; 3) installing ladder on firm, dry footings; 4) avoiding climbing during inclement weather; 5) securing ladder to that which is being climbed; 6) ensuring the proper length and style ladder is used; 7) etc.

Occupational hazard warning systems (i.e., safety signs, safety placards, safety decals, safety posters, tags, labels, etchings, embossings, stampings, etchings, etc.) first appeared in the early 1900's. As manufacturing methods and processes evolved, manufacturers and employers realized a need to communicate safety messages directly to employees as workplace accidents and mishaps became more frequent.

In the decades since their introduction, hazard warning systems have become the primary method and mode for relating and delivering critical safety information directly to employees and visitors in occupational settings. These inexpensive and affective tools provide a "safety message" in the immediate area where the hazard(s) are located.

The earliest of these hazard warning systems contained: one signal word such as "Danger" and one textual hazard message such as "High Voltage." As industry recognized the importance of providing more information on the potential workplace hazards, more information was added and placards evolved.

Safety messaging has evolved in the decades since those rudimentary safety signs. Today, occupational hazard placards contain: one signal word such as "Danger," "Caution," or "Warning;" one textual message which depicts the nature of the hazard (such as "Hazardous Voltage"); one graphic (aka: "safety symbol") which depicts the nature of the hazard (such as a hazard triangle with a lightning bolt); one textual message relating the consequence of interaction with the hazard ("Contact will cause electrical shock or burn"); and one textual message on how to avoid the hazard ("Follow the lockout procedure before servicing this equipment").

Current warnings have also included DVD Videos, that have various disadvantages. Old inventory can have old video content, which means current safety and current warnings are not updated if a DVD or CD is included with the hazardous products.

Another problem with DVD and CD video is they typically are viewed only inside the home/building, etc. Another problem is that DVDs and CDs can break during shipping. DVD and CD formats are easily lost or misplaced, thus making it impossible for the end user and/or subsequent follow-on users to view the safety messaging contained therein.

Thus, the need exists for solutions to the above problems with the prior art.

SUMMARY OF THE INVENTION

A primary objective of the present invention is to provide interactive warning systems, and methods for providing multiple warning labels, instructions, and videos for providing repetitive instructions and warnings to consumers using hazardous products, such as tree stands, and ladders, and the like.

A secondary objective of the present invention is to provide interactive warning systems, and methods that offers a multiple message hazard communication system for use with placards, signs, decals, tags, labels, and any other materials which are designed to convey a safety message. This information is clear and concise, addressing a core or principle hazard and providing users with product specific hazard control information.

A third objective of the present invention is to provide interactive warning systems, and methods that provides users with critical product safety information which offers information on the central nature of the hazard, a central signal word, consequence of interaction with that hazard, and multiple hazard control measures and/or mitigation messaging.

Each individual hazard control and/or mitigation message relates to controlling the core or principle hazard (i.e., "FALL HAZARD"). This multiple message hazard communication system offers multiple safety messages and multiple hazard control techniques without the need to repeat the core or principle nature of the hazard, the core or principle signal word, and the core or principle consequence of interaction with the core or principle hazard.

The present invention provides considerably more concise hazard control information in a smaller physical area than traditional safety labels, placards and/or tags. This allows considerably more concise delivery and presentation of potentially life-saving safety information to be presented in a condensed format while eliminating the messaging redundancy currently found in traditional safety placarding, labeling, etc.

The present invention provides a simple hazard communication and control system which offers consumers with all pertinent safety information without clutter and visually conflicting messaging. The present invention uses a geometric matrix which provides one central hazard class surrounded by a multitude of individual hazard controls. Each of the hazard controls presented around the core of the hazard communication system relate to the central hazard theme. This allows for the presentation of multiple controls without the need of repeating the hazard class, the signal word, and the consequence of hazard interaction. This in turn, saves considerable space, allowing for a more concise delivery of messaging.

Hazard controls may vary in number depending on the divisions of the geometric matrix. Hazard controls can be as few as two and up to as many as are allowed by the physical size of the system. It is envisioned that three to five hazard controls will be optimal.

A hazard communication and control system, can include a main placard for a hazardous product, having a front side and a back side, the front side having a central graphic depicting a core hazard for the hazardous product along with text highlighting a principal hazard for the hazardous product, and a plurality of hazard control symbols depicting hazard control methods related to the principal hazard along with a text hazard control messages for each of the hazard control symbols, the plurality of hazard control symbols each with the text hazard control messages surrounding the central graphic with the text highlighting the principal hazard.

At least one of the plurality of hazard control symbols can include a quick reference (QR) code to link to a website having a video information directly relating to identification and control of the principal hazard for the hazardous product. Preferably up to all of the hazard control symbols can include the quick reference (QR) code.

The text on the central graphic can include a message selected from at least one of signal word such as WARNING, CAUTION and DANGER.

The plurality of hazard control symbols with the text hazard control messages can be divided into separate hazard quadrants.

The plurality of hazard control symbols with the text hazard control messages can be located in symmetrically-divided quadrants.

The back side of the placard can include a second central graphic depicting contact information for a manufacturer of the hazardous product, and a second plurality of hazard control symbols depicting second hazard control methods related to the principal hazard along with second text hazard control messages for each of the second hazard control symbols, the second plurality of hazard control symbols each with the second text hazard control messages surrounding the second central graphic with the text highlighting the principal hazard.

The plurality of hazard control symbols and text hazard control messages on the front side can include general instructions for using the hazardous product, and wherein the second plurality of hazard control symbols each with the second text hazard control messages surrounding the second central graphic with the text highlighting the principal hazard are more specific to safer use of the hazardous product.

The placard can have a general pentagon shape. The placard can include a side protruding tab for indicating both sides of the placard provide for a hazard communication and control to the user.

A hazard communication and control system, can include a plurality of separate hazard communication and controls for use with a hazardous product, wherein each of the plurality of separate hazard communication and controls are used during unpacking and assembly of the hazardous product.

The plurality of separate hazard communication and controls can include a main placard for being directly attached to the hazardous product, the main placard having a front side and a back side, the front side having a central graphic depicting a core hazard for the hazardous product along with text highlighting a principal hazard for the hazardous product, and a plurality of hazard control symbols depicting hazard control methods related to the principal hazard along with a text hazard control messages for each of the hazard control symbols, the plurality of hazard control symbols each with the text hazard control messages surrounding the central graphic with the text highlighting the principal hazard.

At least one of the plurality of hazard control symbols can include a quick reference (QR) code to link to a website having a video information directly relating to identification and control of the principal hazard for the hazardous product.

The text on the central graphic can include a message selected from at least one of WARNING, CAUTION and DANGER.

The plurality of hazard control symbols with the text hazard control messages can be divided into separate hazard quadrants.

The plurality of hazard control symbols with the text hazard control messages can be located in symmetrically-divided quadrants.

The back side of the placard can include a second central graphic depicting contact information for a manufacturer of the hazardous product, and a second plurality of hazard control symbols depicting second hazard control methods related to the principal hazard along with second text hazard control messages for each of the second hazard control symbols, the second plurality of hazard control symbols each with the second text hazard control messages surrounding the second central graphic with the text highlighting the principal hazard.

The plurality of hazard control symbols and text hazard control messages on the front side can include general instructions for using the hazardous product, and the second plurality of hazard control symbols each with the second text hazard control messages surrounding the second central graphic with the text highlighting the principal hazard can be more specific to safer use of the hazardous product.

The plurality separate hazard communication and controls can include a hazard communication and control label on an outside of packaging of hazardous product, the label includes the quick reference (QR) code to link to the website having the video information directly relating to identification and control of the principal hazard for the hazardous product.

The plurality separate hazard communication and controls can include at least one of a tear sheet warning and an instruction warning, placed inside of the packaging that includes the quick reference (QR) code to link to the website having the video information directly relating to identification and control of the principal hazard for the hazardous product.

The plurality separate hazard communication and controls can include an evidence label directly adhered to a surface of the hazardous product, the evidence label providing evidence the hazard control placards have been installed and the evidence label includes the quick reference (QR) code to link to the website having the video information directly relating to identification and control of the principal hazard for the hazardous product.

Further objects and advantages of this invention will be apparent from the following detailed description of the presently preferred embodiments which are illustrated schematically in the accompanying drawings.

BRIEF DESCRIPTION OF THE FIGURES

The drawing figures depict one or more implementations in accord with the present concepts, by way of example only, not by way of limitations. In the figures, like reference numerals refer to the same or similar elements.

FIG. 2A shows a second warning of a tear sheet insert with QR code that can be placed inside the package/box/container shown in FIG. 1B.

DESCRIPTION OF THE PREFERRED EMBODIMENTS

Figure 1A:
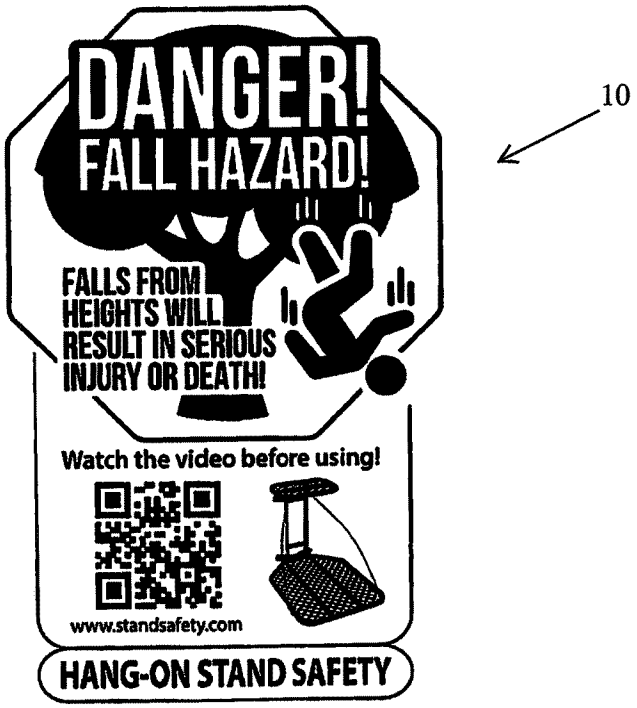
FIG. 1A is an enlarged view a first warning label with QR code link to video before using the hazardous product that can be placed on outer surface of the outside package/box/container of the hazardous product.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation. In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like numbers refer to like elements throughout, and prime notation is used to indicate similar elements in alternative embodiments.

Multiple hazard control messages can be related to the principal hazard message and reduces redundancy related to the common signal word such as "Danger," "Warning" and "Caution" labels, increasing message effectiveness while reducing the physical size of the label. QR codes are included to provide consumers with digitally-based, hazard communication and hazard control information dramatically increasing the hazard communication and control effectiveness of this system over traditional "Danger," "Warning" and "Caution" labels.

The novel systems and methods can allow for labels and placards/tags to be used with any potentially hazardous products as described in the example below.

In one embodiment, the novel hazard control system and method can be adapted for a hazardous product, such a tree stand product that include the actual tree stand along with accessory products for the tree stand that can include but are not limited to a separate harness and a ratchet strap.

In this embodiment, there can be eight (8) different hazard warnings and controls for the user of the tree stand product and the accessories of the harness and ratchet strap as indicated in I through VIII below. In this embodiment, there can be eight (8) layers of Product Defensibility that provide safety for the users as well as extra liability protection for the hazardous product manufacturer.

I FIRST WARNING Danger Warning Label with QR code link to video before using on outside box/package;

QR logos can be included on the face of product packaging to quickly warn users and like to a specific online safety video;

II SECOND WARNING—Tear sheet insert placed inside of box/package. Warning to view video with QR code link to video.

Sheet must be included on top of the instructions so it is one of the first things the user sees. A preferred embodiment can be ½ sheet (or full sheet), different colored paper, such as yellow paper, and/or grayscale or color, with or without identical print on both sides.

III THIRD WARNING—Harness Instruction Insert placed inside of box/package.

IV FOURTH WARNING—Tree Stand Instruction Insert (label, hang-tag, placard) placed inside of box/package.

V FIFTH WARNING—Main Product Placard/Tag placed on main product (tree stand).

12 Different Warnings & Instructions on this placard alone

VI SIXTH WARNING—Components/Accessories Placard/Tag placed on Components/Accessories (Harness)

11 Different Warnings & Instructions on this placard alone

VII SEVENTH WARNING—Components/Accessories Placard/Tag placed on Components/Accessories (Ratchet Strap)

11 Different Warnings & Instructions on this placard alone

VIII EIGHTH WARNING—Evidence Label Sticky Type Label placed on all products (tree stand, harness, ratchet strap)

Provides evidence the placards were installed on all products

Provides Trackability and Traceability

FIG. 1A is an enlarged view a first warning label with QR code link to video before using the hazardous product that can be placed on the outside package/box/container of the hazardous product. The first warning label 10 can include a graphic depicting a core hazard for the hazardous product along with text highlighting a principal hazard for the hazardous product. Additionally, the first warning label can include a quick reference (QR) code to link to a website having a video information directly relating to identification and control of the principal hazard for the hazardous product.

Figure 1B:
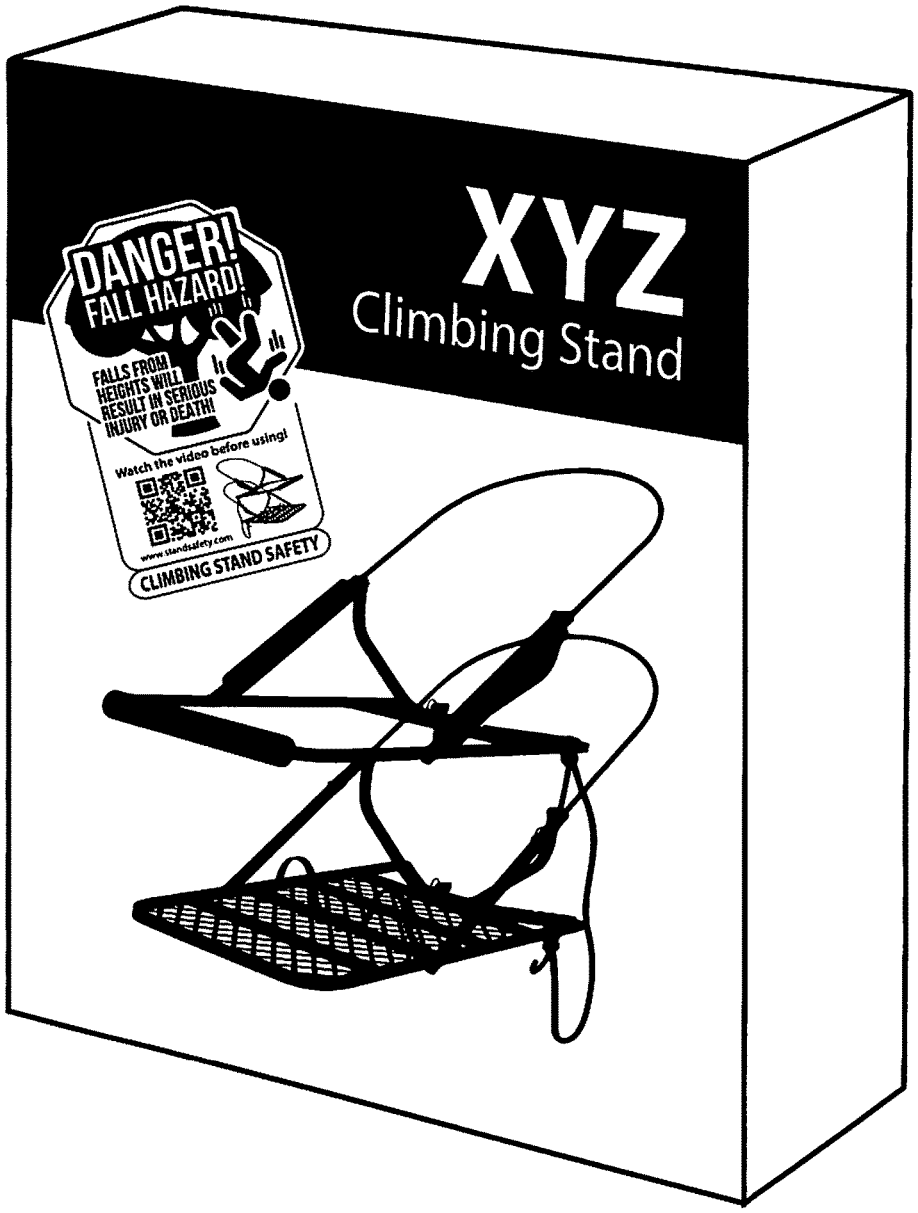
FIG. 1B shows a package/box/container of the hazardous product with the first warning label of FIG. 1A.

FIG. 1B shows a package/box/container of the hazardous product with the first warning label 10 of FIG. 1A.

FIG. 2A shows a second warning of a tear sheet insert 20 with QR code that can be placed inside the package/box/container shown in FIG. 1B. The tear sheet can include another image of the quick reference (QR) code to link to a website having a video information directly relating to identification and control of the principal hazard for the hazardous product.

Figure 2B:
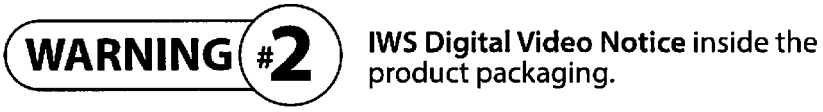
FIG. 2B shows the package/box/container with the second warning tear sheet with QR code of FIG. 2A inserted inside.
Figure 2B:
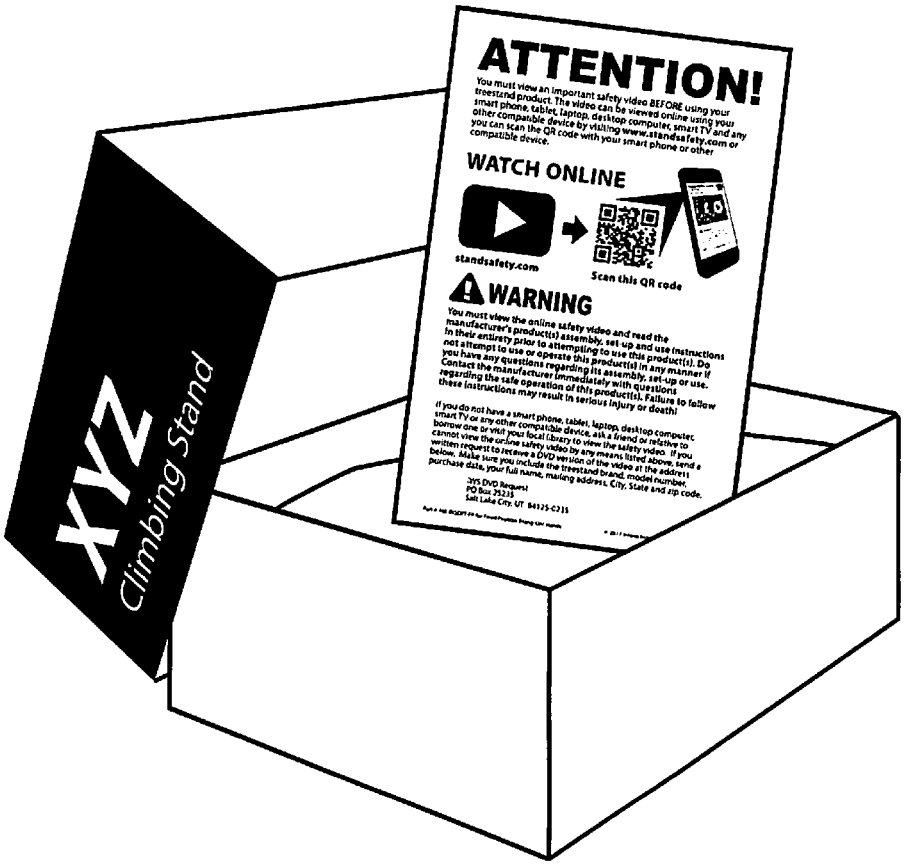

FIG. 2B shows the package/box/container with the second warning tear sheet 20 with QR code of FIG. 2A inserted inside.

Figure 3A:
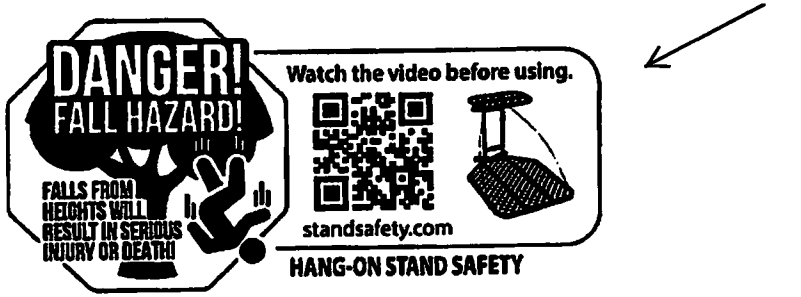
FIG. 3A shows a third warning label with QR code link to video before using the hazardous product that can be placed on outer surface of the outside package/box/container of the hazardous product.

FIG. 3A shows a third warning label 30 with QR code link to video before using the hazardous product that can be placed on outer surface of the outside package/box/container of the hazardous product. The third warning label 30 can also include a graphic depicting a core hazard for the hazardous product along with text highlighting a principal hazard for the hazardous product. Additionally, the first warning label can include a quick reference (QR) code to link to a website having a video information directly relating to identification and control of the principal hazard for the hazardous product.

Figure 3B:
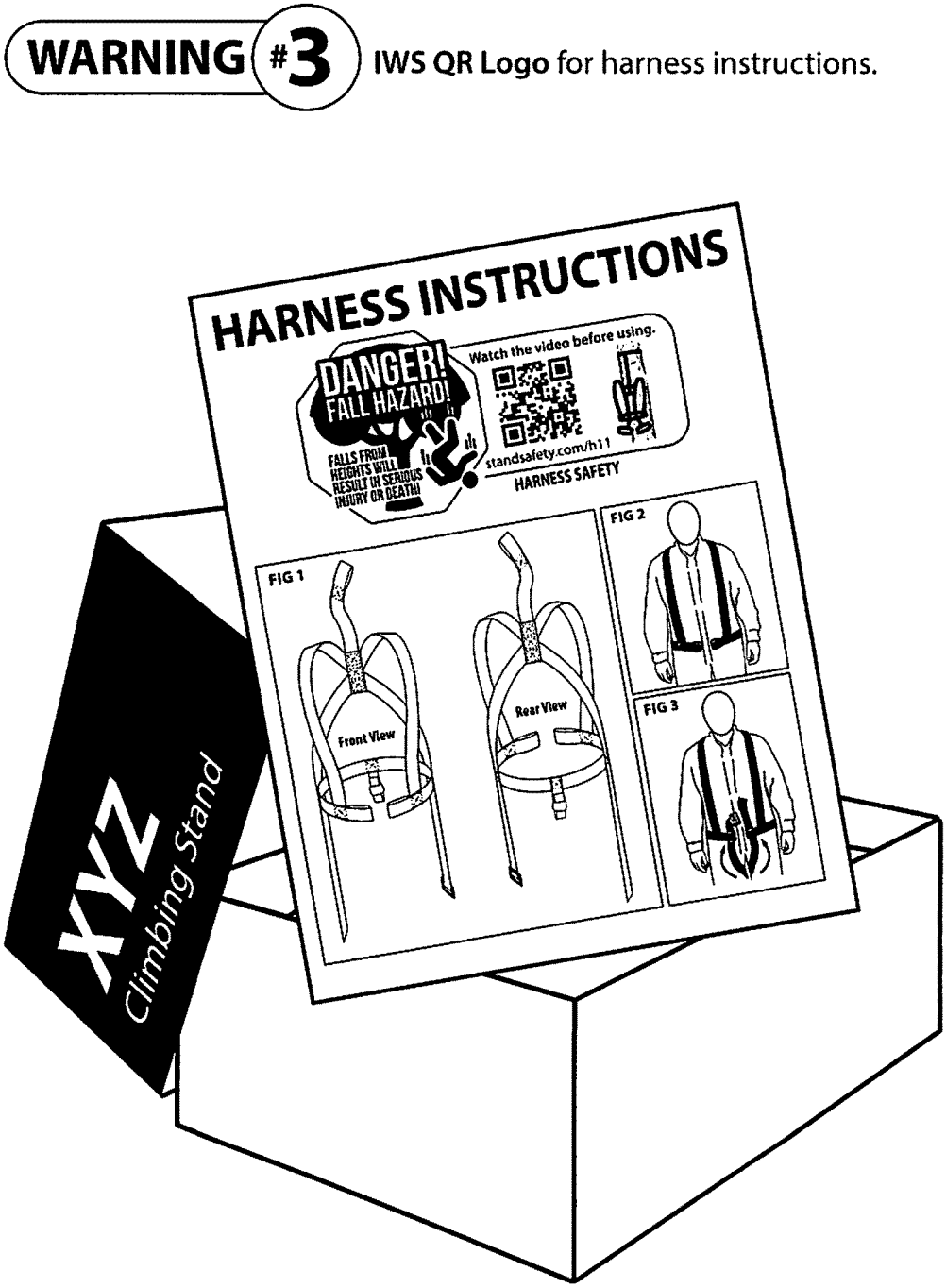
FIG. 3B shows a harness instruction sheet with the third warning label of FIG. 3A as an insert placed in the package/box/container of the hazardous product.

FIG. 3B shows a harness instruction sheet with the third warning label 30 of FIG. 3A as an insert placed in the package/box/container of the hazardous product.

Figure 4:
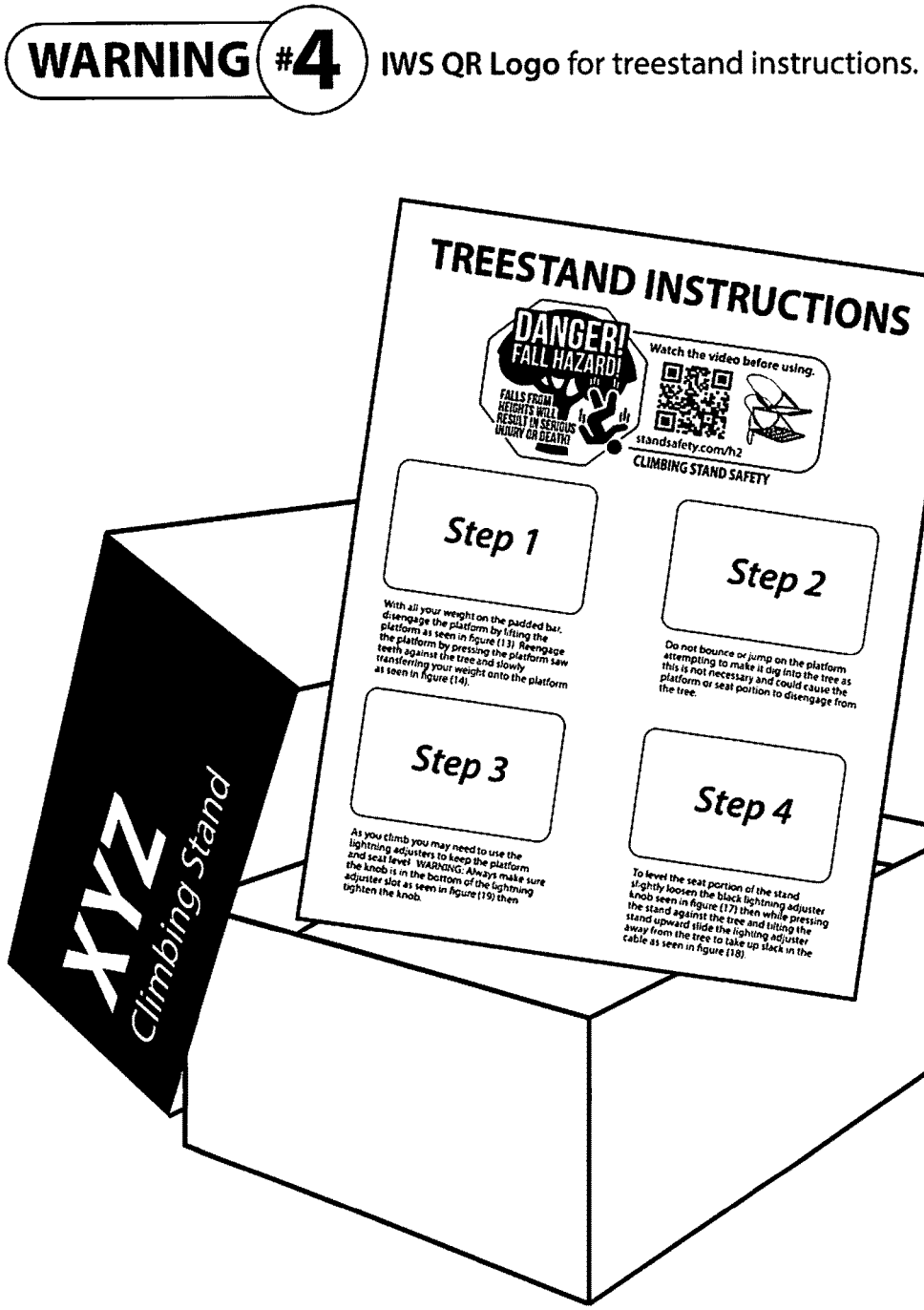
FIG. 4 shows the harness instruction sheet of FIG. 3B and tree stand instruction sheet both with the third warning label of FIG. 3A both as an insert placed in the package/box/container of the hazardous product.

FIG. 4 shows the harness instruction sheet of FIG. 3B and tree stand instruction sheet both with the third warning label 30 of FIG. 3A both as an insert placed in the package/box/container of the hazardous product.

Figure 5A:
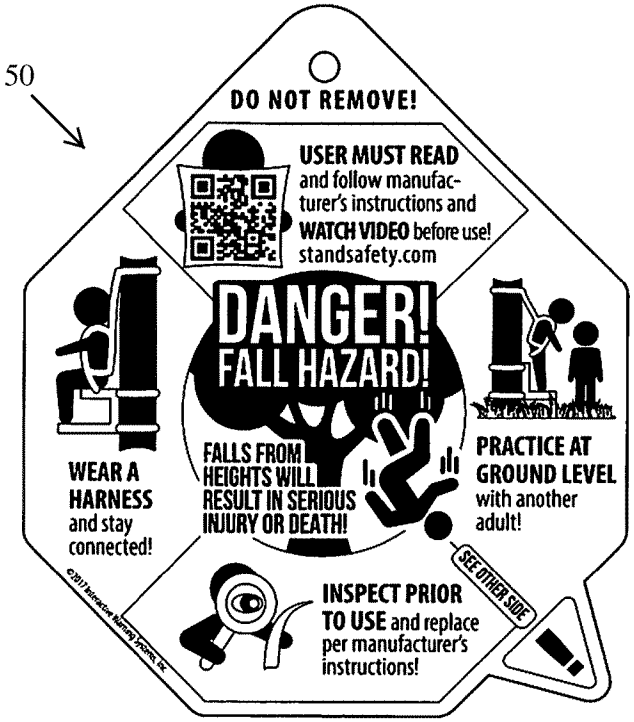
FIG. 5A is a front view of a main hazard warning and control placard for being attached to the tree stand hazardous product.
Figure 5B:
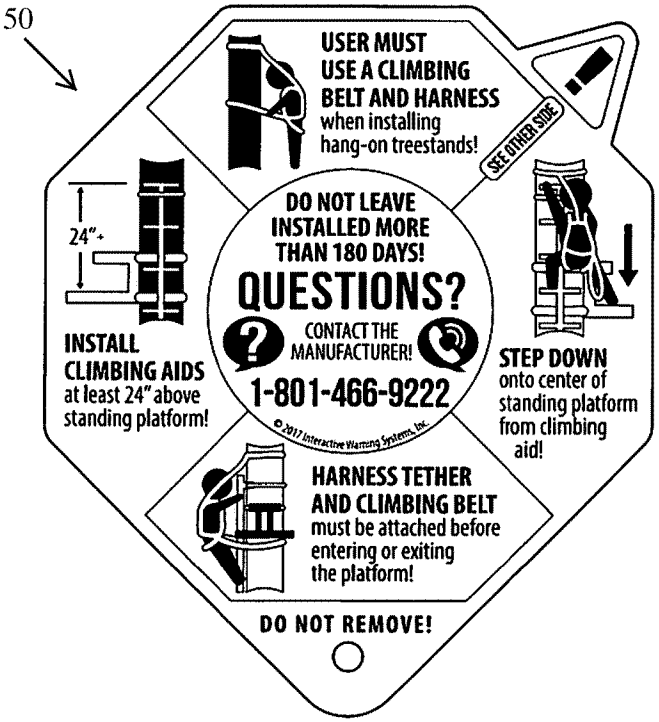
FIG. 5B is a back view of the placard of FIG. 5A.

FIG. 5A is a front view of a placard 50 for being attached to the tree stand hazardous product. FIG. 5B is a back view of the placard 50 of FIG. 5A. Referring to FIGS. 5A-5B, the placard 50 can be a stiff tag formed from plastic, cardboard, and the like, having waterproof surfaces with a front side and a back side. The placards 50 can include tags with printed/written notice for public display.

The placard 50 can be a hang tag, which can use a strand, such as a wire, plastic, and the like to attach the placard 50 to the main hazardous product.

The front side of the placard 50 can have a central graphic depicting a core hazard for the hazardous product along with text highlighting a principal hazard for the hazardous product, and a plurality of hazard control symbols depicting hazard control methods related to the principal hazard along with a text hazard control messages for each of the hazard control symbols. The plurality of hazard control symbols each with the text hazard control messages can surround the central graphic with the text highlighting the principal hazard. There can be approximately 2 to approximately 5 hazard control symbols each with the text hazard control messages can surround the central graphic with the text highlighting the principal hazard. hazard control symbols each with the text hazard control messages can surround the central graphic with the text highlighting the principal hazard.

At least one of the plurality of hazard control symbols includes a quick reference (QR) code to link to a website having a video information directly relating to identification and control of the principal hazard for the hazardous product.

The text on the central graphic of the front of the placard 50 can include a message selected from at least one of WARNING, CAUTION and DANGER.

The plurality of hazard control symbols with the text hazard control messages on the front side of the placard 50 can be divided into separate hazard quadrants.

The plurality of hazard control symbols with the text hazard control messages on the front side of the placard 50 can be located in symmetrically-divided quadrants.

The back side of the placard 50 can include a second central graphic depicting contact information for a manufacturer of the hazardous product, and a second plurality of hazard control symbols depicting second hazard control methods related to the principal hazard along with second text hazard control messages for each of the second hazard control symbols.

The second plurality of hazard control symbols each with the second text hazard control messages surrounding the second central graphic with the text highlighting the principal hazard. The plurality of hazard control symbols and text hazard control messages on the front side include general instructions for using the hazardous product, and the second plurality of hazard control symbols each with the second text hazard control messages surrounding the second central graphic with the text highlighting the principal hazard can be more specific to safer use of the hazardous product as shown in comparing FIG. 5B to FIG. 5A.

An embodiment of the placard 50 can have a general pentagon shape. The placard 50 can include a side protruding tab for indicating both sides of the placard provide for a hazard communication and control to the user.

Figure 5C:
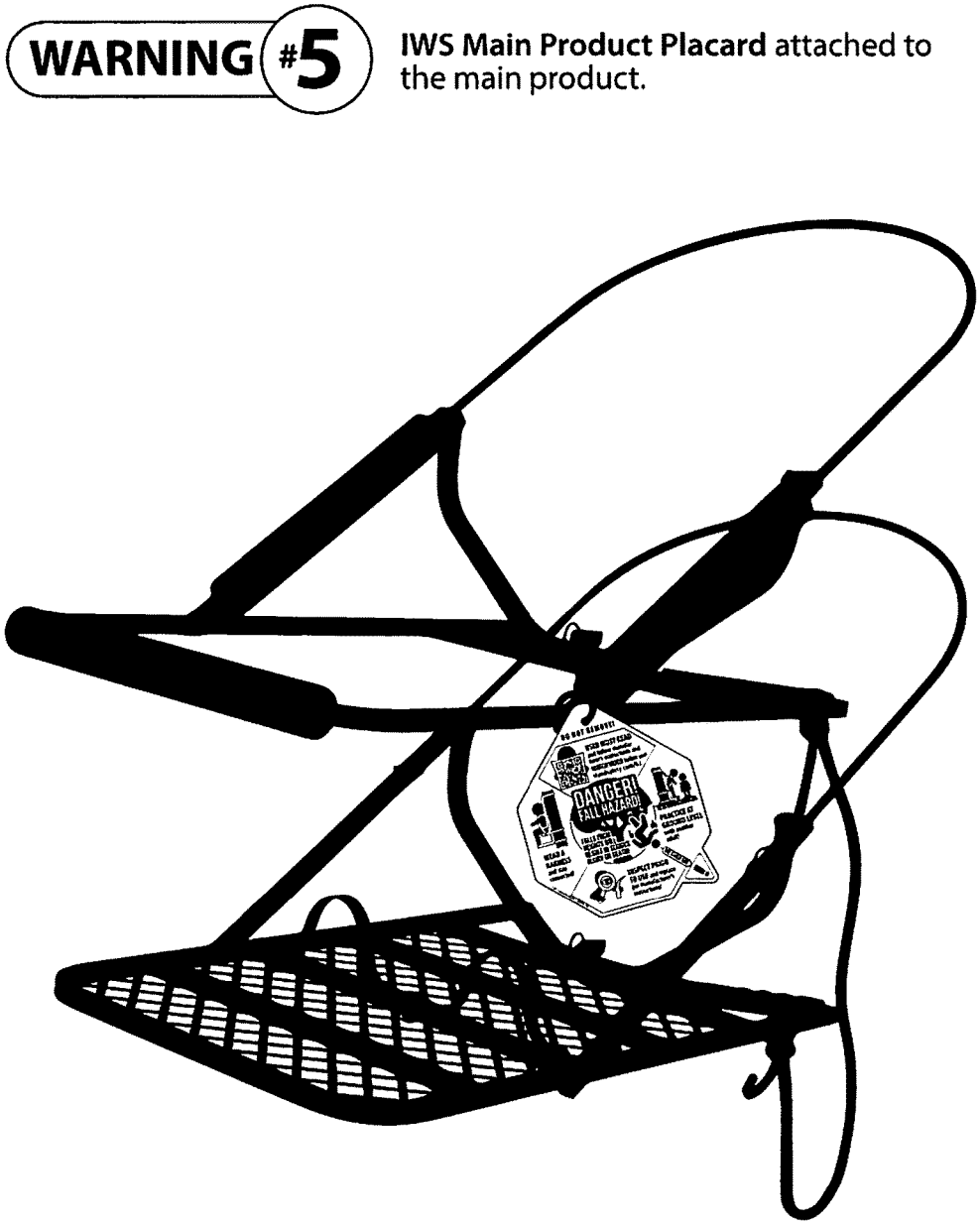
FIG. 5C shows a tree stand hazardous product with the placard of FIGS. 5A-5B directly attached thereto.

FIG. 5C shows a tree stand hazardous product with the placard 50 of FIGS. 5A-5B directly attached thereto.

Figure 6A:
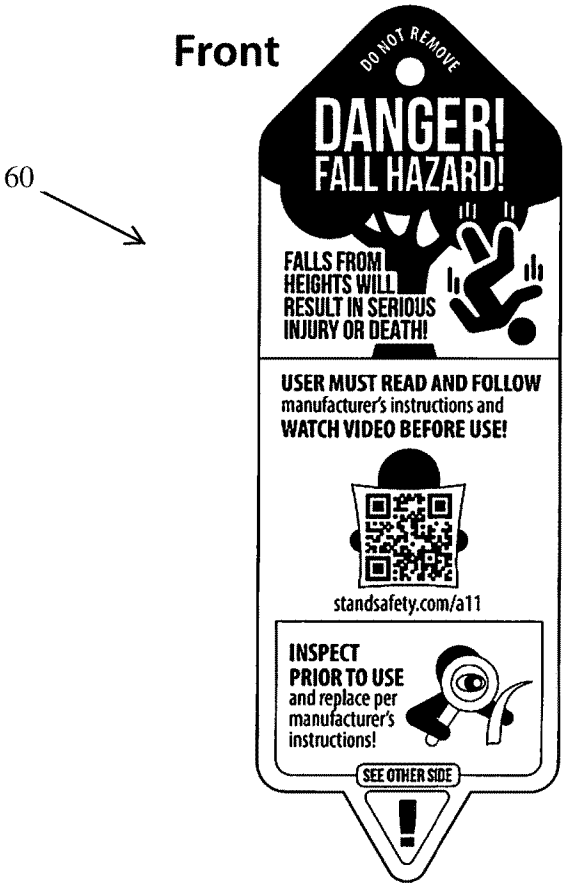
FIG. 6A is a front side of second hazard warning and control placard with QR code, for use with accessories to the main hazard product.
Figure 6B:
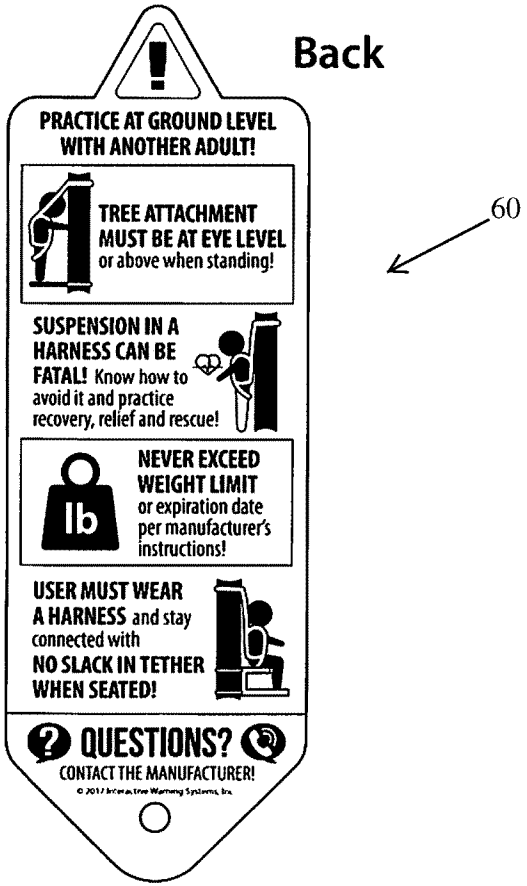
FIG. 6B is a back side of the second hazard warning control placard of FIG. 6A.

FIG. 6A is a front side of second hazard warning and control placard 60 with QR code, for use with accessories to the main hazard product, such as the tree stand. FIG. 6B is a back side of the second hazard warning control placard 60 of FIG. 6A. The second placard 60 can be made from similar material as the main placard 50, and have a longitudinal shape, such as but not limited to generally rectangular, and the like, and also include a tab edge which indicates to the user there are two sides of warnings and instructions. The second placard 60 can be a hang tag, which can use a strand, such as a wire, plastic, and the like to attach the second placard 60 to the accessories.

The second placard 60 can include a quick reference (QR) code to link to a website having a video information directly relating to identification and control of the principal hazard for the hazardous product. The second placard 60 can include up to approximately eleven or more different warnings and instructions on this placard alone. A graphic on the front of the placard 60 can also include a message selected from at least one of WARNING, CAUTION and DANGER. The back side of the placard 60 can include more specific controls and warnings and instructions than on the front side.

Figure 6C:
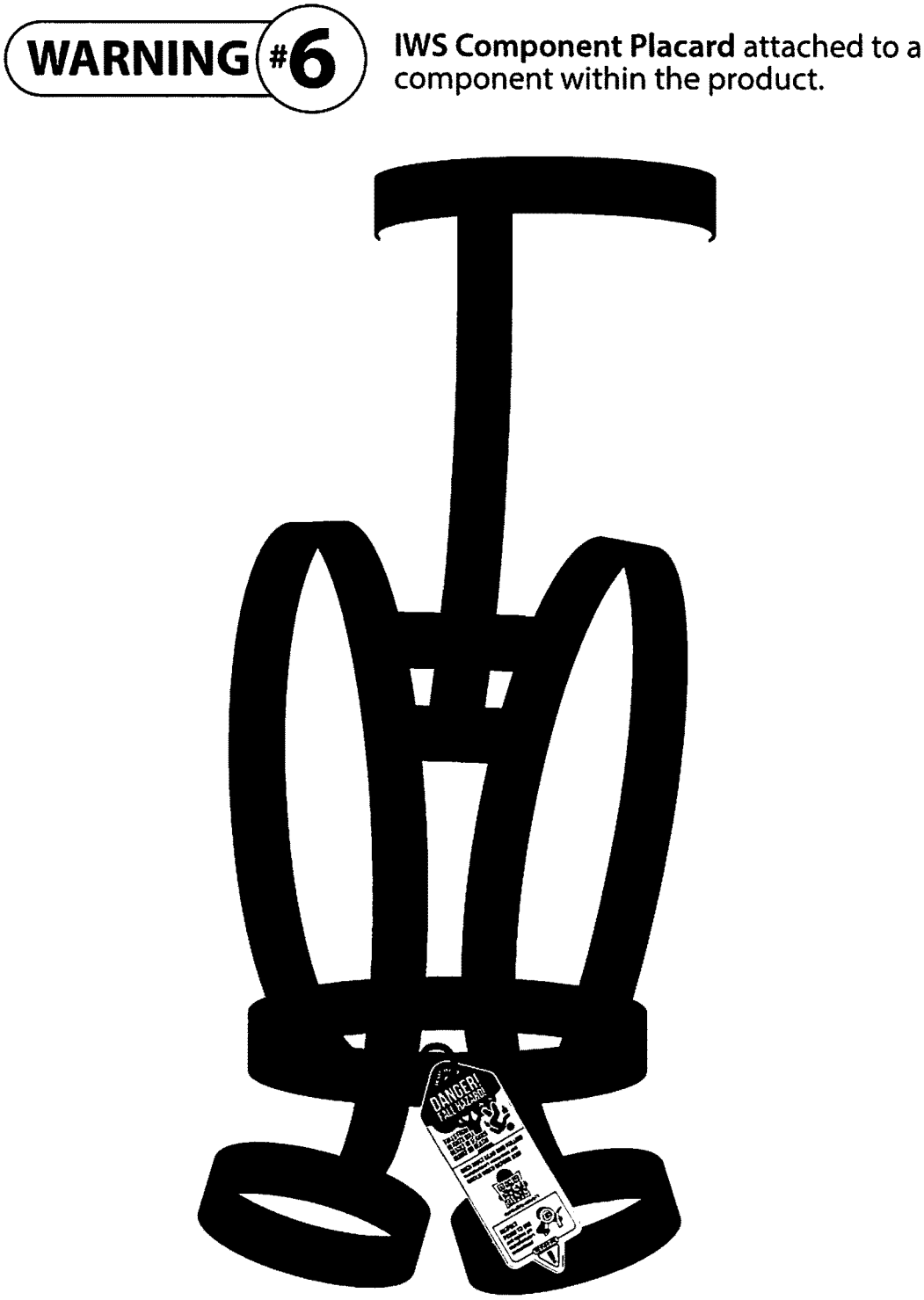
FIG. 6C shows an accessory (harness) to the main hazardous product with the second hazard warning control placard attached thereto.

FIG. 6C shows an accessory (harness) to the main hazardous product with the second hazard warning control placard 60 attached thereto.

Figure 7:
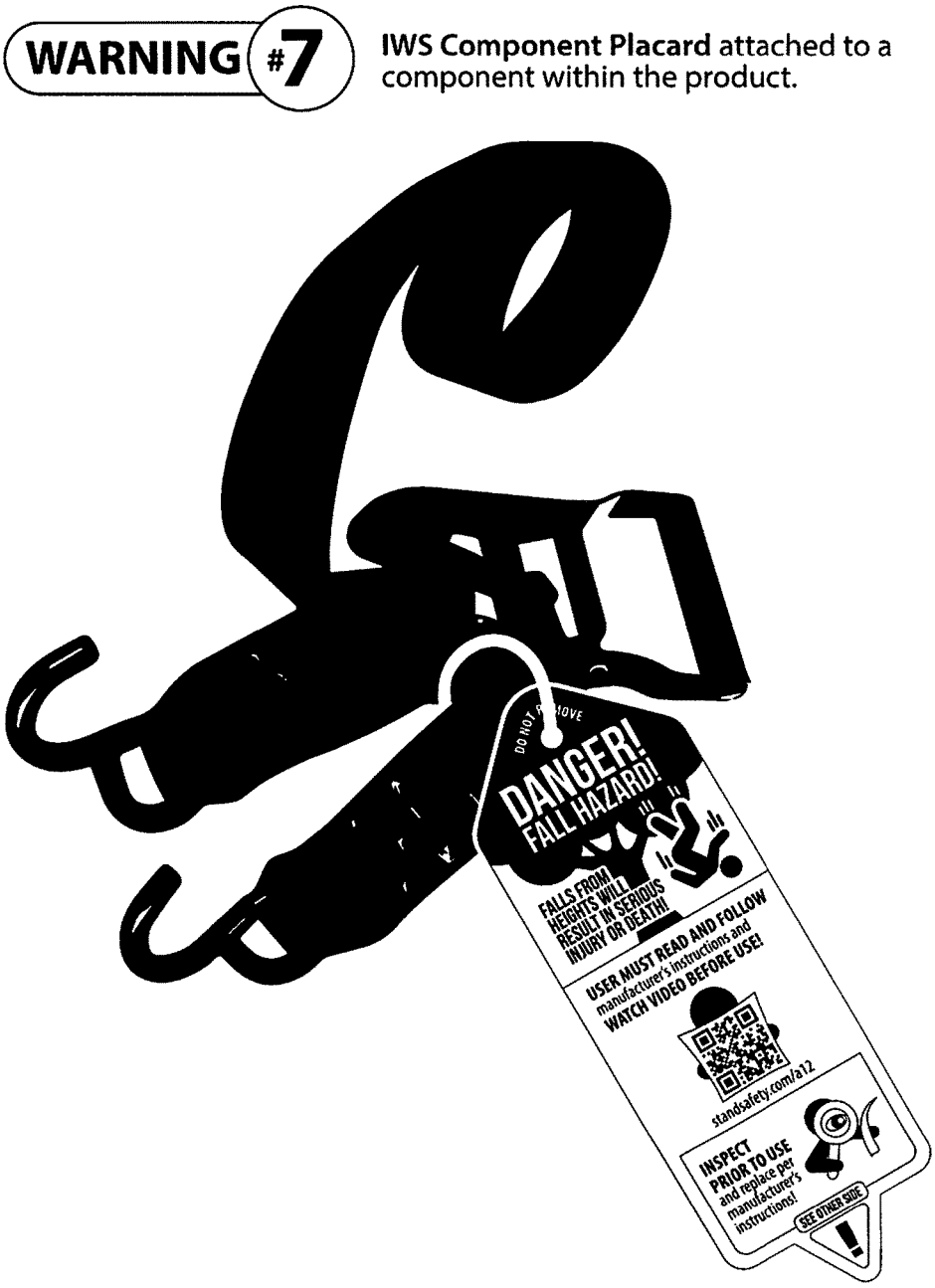
FIG. 7 shows another accessory (ratchet strap) to the main hazardous product with the second hazard warning control placard attached thereto.

FIG. 7 shows another accessory (ratchet strap) to the main hazardous product with the second hazard warning control placard 60 attached thereto.

Figure 8A:
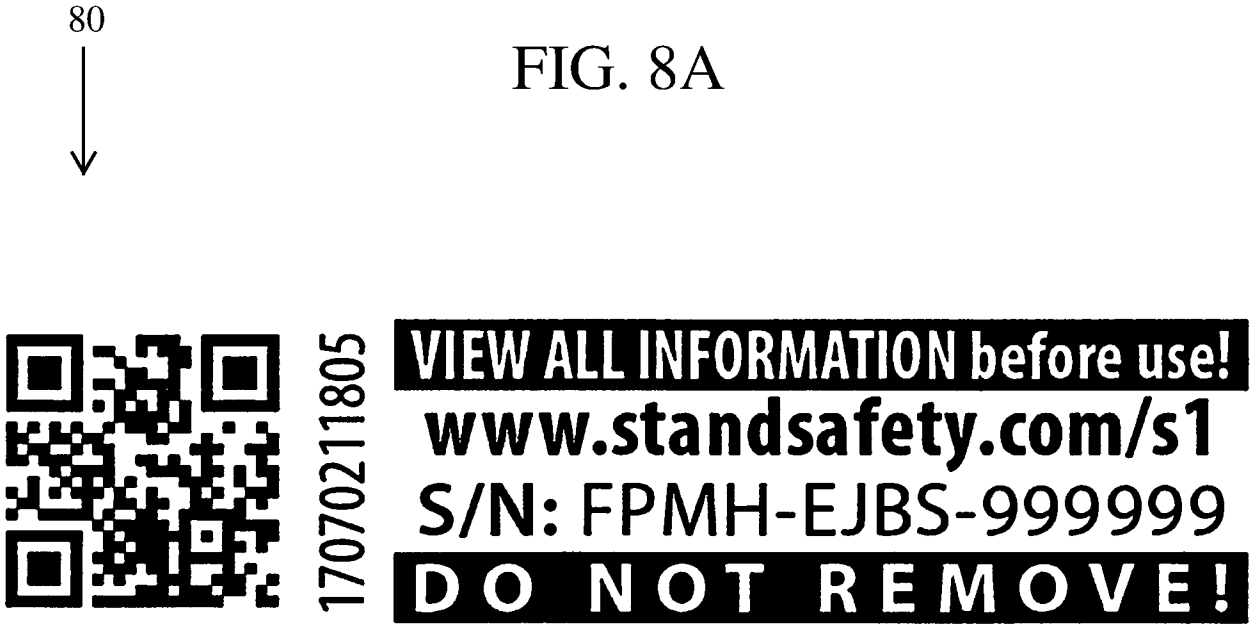
FIG. 8A shows a stick-on evidence label with QR code.

FIG. 8A shows a stick-on evidence label 80 with QR code. The evidence labels 80 can having a sticky backing that makes the label 80 difficult to remove, and can include a quick reference (QR) code to link to a website having a video information directly relating to identification and control of the principal hazard for the hazardous product. The label 80 can also include URL inks and be serialized. The evidence labels 80 can be adhered directly to the hazardous product is evidence that the evidence label has been installed. The evidence label 80 can also be adhered directly to all separate components, such as the main hazardous product and all of the accessories to the main hazardous product.

Figure 8B:
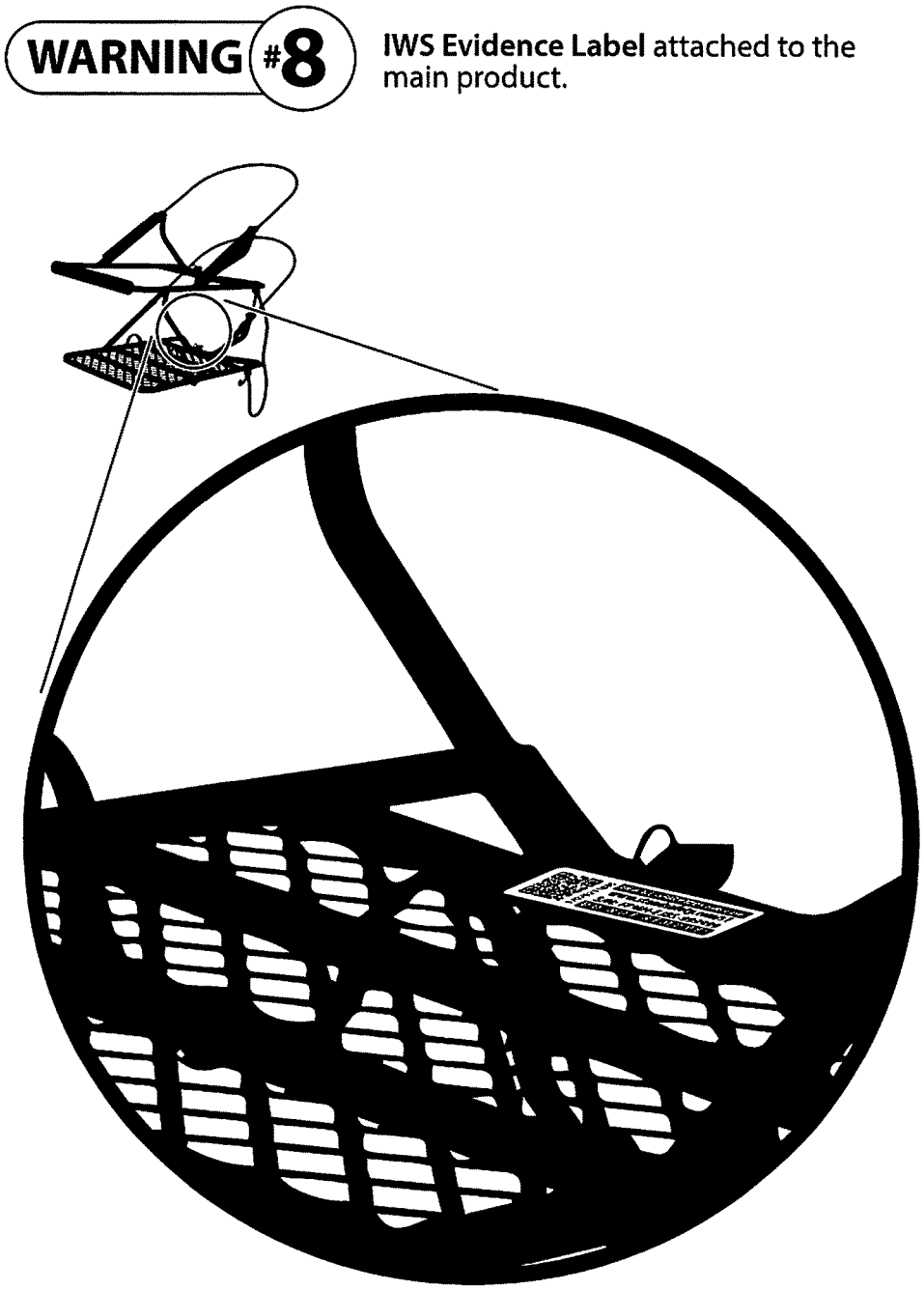
FIG. 8B shows the evidence label of FIG. 8A directly adhered to the hazardous product.

FIG. 8B shows the evidence label 80 of FIG. 8A directly adhered to the hazardous product.

All of the placards and tags and labels referenced above can also include "DO NOT REMOVE" instructions as well.

Examples of other hazardous products that can use the novel interactive warning systems and controls can include but is not limited to hang on stands, climbing stands, ladder stands, jaw ladder stands, tripod stands, aftermarket harnesses, stick ladders, climbing aids (non-continuous), tree stand safety rope (lifeline), self rescue devices, OEM (original equipment manufacturer) harness, OEM ratchet straps, OEM cam-buckle straps, OEM tree belts, and the like.

Although the hazardous communications system and method provides embodiments in English, the system and methods can be provided in multiple languages simultaneously.

The hazardous communications system and method can be provided in symmetrically-divided quadrants. The hazardous communications system and method can also be provided in non-symmetrically divided quadrants.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A hazard communication and control system for hazardous products, comprising in combination:

a main placard for a hazardous product, having a front side and a back side, the front side having a central graphic depicting a core hazard for the hazardous product along with text highlighting a principal hazard for the hazardous product, and a plurality of hazard control symbols depicting hazard control methods related to the principal hazard along with a text hazard control messages for each of the hazard control symbols, the plurality of hazard control symbols each with the text hazard control messages surrounding the central graphic with the text highlighting the principal hazard, wherein the back side of the placard includes a second central graphic depicting contact information for a manufacturer of the hazardous product, and a second plurality of hazard control symbols depicting second hazard control methods related to the principal hazard along with second text hazard control messages for each of the second hazard control symbols, the second plurality of hazard control symbols each with the second text hazard control messages surrounding the second central graphic with the text highlighting the principal hazard, wherein at least one of the plurality of the hazard control symbols includes a quick reference (QR) code; and a hazardous product website that is accessed by a link from the quick reference (QR) code;

a hazardous information video on the website, wherein playing the video is directly related to identification and control of the principal hazard for the hazardous product;

the main placard being attached to a first component of the hazardous product, the central graphic depicting the core hazard for the first component of the hazardous product along with text highlighting the principal hazard for the first component of the hazardous product, and the plurality of hazard control symbols depicting hazard control methods related to the principal hazard for the first component, along with a text hazard control messages for each of the hazard control symbols, the plurality of hazard control symbols each with the text hazard control messages surrounding the central graphic with the text highlighting the principal hazard, the hazardous information video on the website being a first hazardous information video that is directly related to the identification and the control of the principal hazard for the first component of the hazardous product;

a second placard for a second component of the hazardous product, having a front side with a second central graphic depicting a second core hazard for the second component of the hazardous product along with text highlighting a principal hazard for the second component of the hazardous product, and a second plurality of hazard control symbols depicting hazard control methods related to the principal hazard along with second text hazard control messages for each of the second hazard control symbols, the second plurality of hazard control symbols each with the second text hazard control messages surrounding the second central graphic with the second text highlighting the principal hazard of the second component of the hazardous product;

a second quick reference (QR) code on the front side, the second quick reference (QR) code providing a second website link, the second quick reference (QR) code being different from the quick reference (QR) code;

the hazardous product website for being accessed from the second website link from the second quick reference (QR) code; and a second hazardous information video on the website, wherein playing the second hazardous information video is directly related to identification and control of the principal hazard for the second component of the hazardous product, the second hazardous information video being different from the first hazardous information video.

2. The hazard communication and control system of claim 1, wherein the text on the central graphic includes a message selected from at least one of WARNING, CAUTION and DANGER.

3. The hazard communication and control system of claim 1, wherein the plurality of hazard control symbols with the text hazard control messages, are divided into separate hazard quadrants or are located in symmetrically-divided quadrants.

4. The hazard communication and control system of claim 1, wherein the plurality of hazard control symbols and text hazard control messages on the front side include general instructions for using the hazardous product, and wherein the second plurality of hazard control symbols each with the second text hazard control messages surrounding the second central graphic with the text highlighting the principal hazard are more specific to safer use of the hazardous product.

5. The hazard communication and control system of claim 1, wherein the placard has a general pentagon shape.

6. The hazard communication and control system of claim 5, wherein the placard includes a side protruding tab for indicating both sides of the placard provide for a hazard communication and control to the user.

7. A method of using the hazard communication and control system of claim 1, comprising the method steps of:

directly attaching the main placard to the hazardous product;

scanning the quick reference (QR) code with a smart phone;

linking to the hazardous product website on the smart phone;

playing the hazardous information video on the hazardous product website, which is directly related to the identification and the control of the principal hazard for the hazardous product.

8. A hazard communication and control system for hazardous products, comprising:

a plurality of separate hazard communication and controls for use with a hazardous product, wherein each of the plurality of separate hazard communication and controls are used during unpacking and assembly of the hazardous product, wherein the plurality of separate hazard communication and controls includes:

a main placard for being directly attached to the hazardous product, the main placard having a front side and a back side, the front side having a central graphic depicting a core hazard for the hazardous product along with text highlighting a principal hazard for the hazardous product, and a plurality of hazard control symbols depicting hazard control methods related to the principal hazard along with a text hazard control messages for each of the hazard control symbols, the plurality of hazard control symbols each with the text hazard control messages surrounding the central graphic with the text highlighting the principal hazard, wherein at least one of the plurality of hazard control symbols includes a quick reference (QR) code link;

a hazardous product website being accessed by the quick reference (QR) code link;

a hazardous information video on the hazardous product website, wherein playing the video is directly related to identification and control of the principal hazard for the hazardous product;

the main placard being attached to a first component of the hazardous product, the central graphic depicting the core hazard for the first component of the hazardous product along with text highlighting the principal hazard for the first component of the hazardous product, and the plurality of hazard control symbols depicting hazard control methods related to the principal hazard for the first component, along with a text hazard control messages for each of the hazard control symbols, the plurality of hazard control symbols each with the text hazard control messages surrounding the central graphic with the text highlighting the principal hazard, the hazardous information video on the website being a first hazardous information video that is directly related to the identification and the control of the principal hazard for the first component of the hazardous product;

a second placard for a second component of the hazardous product, having a front side with a second central graphic depicting a second core hazard for the second component of the hazardous product along with text highlighting a principal hazard for the second component of the hazardous product, and a second plurality of hazard control symbols depicting hazard control methods related to the principal hazard along with second text hazard control messages for each of the second hazard control symbols, the second plurality of hazard control symbols each with the second text hazard control messages surrounding the second central graphic with the second text highlighting the principal hazard of the second component of the hazardous product;

a second quick reference (QR) code on the front side, the second quick reference (QR) code providing a second website link, the second quick reference (QR) code being different from the quick reference (QR) code;

the hazardous product website for being accessed from the second website link from the second quick reference (QR) code; and a second hazardous information video on the website, wherein playing the second hazardous information video is directly related to identification and control of the principal hazard for the second component of the hazardous product, the second hazardous information video being different from the first hazardous information video.

9. The hazard communication and control system of claim 8, wherein the text on the central graphic includes a message selected from at least one of WARNING, CAUTION and DANGER.

10. The hazard communication and control system of claim 8, wherein the plurality of hazard control symbols with the text hazard control messages are divided into separate hazard quadrants or are located in symmetrically-divided quadrants.

11. The hazard communication and control system of claim 8, wherein the back side of the placard includes:

a second central graphic depicting contact information for a manufacturer of the hazardous product, and a second plurality of hazard control symbols depicting second hazard control methods related to the principal hazard along with second text hazard control messages for each of the second hazard control symbols, the second plurality of hazard control symbols each with the second text hazard control messages surrounding the second central graphic with the text highlighting the principal hazard.

12. The hazard communication and control system of claim 11, wherein the plurality of hazard control symbols and text hazard control messages on the front side include general instructions for using the hazardous product, and wherein the second plurality of hazard control symbols each with the second text hazard control messages surrounding the second central graphic with the text highlighting the principal hazard are more specific to safer use of the hazardous product.

13. The hazard communication and control system of claim 8, wherein the plurality separate hazard communication and controls further includes:

a hazard communication and control label on an outside of packaging of hazardous product, the label includes the quick reference (QR) code to link to the website having the video information directly relating to identification and control of the principal hazard for the hazardous product.

14. The hazard communication and control system of claim 13, wherein the plurality separate hazard communication and controls further includes:

at least one of a tear sheet warning and an instructions sheet warning, placed inside of the packaging that includes the quick reference (QR) code to link to the website having the video information directly relating to identification and control of the principal hazard for the hazardous product.

15. The hazard communication and control system of claim 14, wherein the plurality separate hazard communication and controls further includes:

an evidence label directly adhered to a surface of the hazardous product, the evidence label providing evidence the hazard control placards have been installed and the evidence label includes the quick reference (QR) code to link to the website having the video information directly relating to identification and control of the principal hazard for the hazardous product.

16. A method of using hazard communication and control system of claim 8, comprising the method steps of:

directly attaching the main placard to the hazardous product;

scanning the quick reference (QR) code with a smart phone;

linking to the hazardous product website on the smart phone;

playing the hazardous information video on the hazardous product website, which is directly related to the identification and the control of the principal hazard for the hazardous product.

17. A hazard communication and control system for hazardous products, comprising:

a main placard for a hazardous product, having a front side with a central graphic depicting a core hazard for the hazardous product along with text highlighting a principal hazard for the hazardous product, and a plurality of hazard control symbols depicting hazard control methods related to the principal hazard along with a text hazard control messages for each of the hazard control symbols, the plurality of hazard control symbols each with the text hazard control messages surrounding the central graphic with the text highlighting the principal hazard;

a quick reference (QR) code on the front side, the quick reference (QR) code providing a website link;

a hazardous product website for being accessed from the link from the quick reference (QR) code;

a hazardous information video on the website, wherein playing the video is directly related to identification and control of the principal hazard for the hazardous product;

the main placard being attached to a first component of the hazardous product, the central graphic depicting the core hazard for the first component of the hazardous product along with text highlighting the principal hazard for the first component of the hazardous product, and the plurality of hazard control symbols depicting hazard control methods related to the principal hazard for the first component, along with a text hazard control messages for each of the hazard control symbols, the plurality of hazard control symbols each with the text hazard control messages surrounding the central graphic with the text highlighting the principal hazard, the hazardous information video on the website being a first hazardous information video that is directly related to the identification and the control of the principal hazard for the first component of the hazardous product;

a second placard for a second component of the hazardous product, having a front side with a second central graphic depicting a second core hazard for the second component of the hazardous product along with text highlighting a principal hazard for the second component of the hazardous product, and a second plurality of hazard control symbols depicting hazard control methods related to the principal hazard along with second text hazard control messages for each of the second hazard control symbols, the second plurality of hazard control symbols each with the second text hazard control messages surrounding the second central graphic with the second text highlighting the principal hazard of the second component of the hazardous product;

a second quick reference (QR) code on the front side, the second quick reference (QR) code providing a second website link, the second quick reference (QR) code being different from the quick reference (QR) code;

the hazardous product website for being accessed from the second website link from the second quick reference (QR) code; and a second hazardous information video on the website, wherein playing the second hazardous information video is directly related to identification and control of the principal hazard for the second component of the hazardous product, the second hazardous information video being different from the first hazardous information video.

18. A method of using the hazard communication and control system of claim 17, comprising the method steps of:

directly attaching the main placard to the hazardous product;

scanning the quick reference (QR) code with a smart phone;

linking to the hazardous product website on the smart phone;

playing the hazardous information video on the hazardous product website, which is directly related to the identification and the control of the principal hazard for the hazardous product.

* * * * *